US006668399B2

(12) United States Patent
Malstaff et al.

(10) Patent No.: US 6,668,399 B2
(45) Date of Patent: Dec. 30, 2003

(54) BOLSTER SYSTEM FOR A PATIENT SUPPORT SURFACE

(75) Inventors: Christopher Malstaff, San Antonio, TX (US); Maria Teresa Tejeda, Cibolo, TX (US); Olga R. Garibay, San Antonio, TX (US); Laurence P. Trott, Cornelius, NC (US)

(73) Assignee: KCI Licensing, Inc., San Antonio, TX (US)

( * ) Notice: Subject to any disclaimer, the term of this patent is extended or adjusted under 35 U.S.C. 154(b) by 36 days.

(21) Appl. No.: 10/061,505

(22) Filed: Feb. 1, 2002

(65) Prior Publication Data

US 2003/0150057 A1 Aug. 14, 2003

(51) Int. Cl.[7] ..... A61G 7/057
(52) U.S. Cl. ..... 5/424; 5/425; 5/663; 5/732
(58) Field of Search ..... 5/424, 425, 663, 5/630, 632, 426, 427, 731, 732, 946

(56) References Cited

U.S. PATENT DOCUMENTS

| | | | | |
|---|---|---|---|---|
| 2,644,173 A | * | 7/1953 | James | 5/425 |
| 2,722,693 A | * | 11/1955 | Wolf | 5/426 |
| 4,574,412 A | * | 3/1986 | Smith | 5/632 |
| 4,872,228 A | | 10/1989 | Bishop | |
| 5,035,014 A | * | 7/1991 | Blanchard | 5/424 |
| 5,530,974 A | | 7/1996 | Rains et al. | |
| 5,575,025 A | * | 11/1996 | Peters | 5/600 |
| 5,802,646 A | | 9/1998 | Stolpmann et al. | |
| 5,926,873 A | * | 7/1999 | Fountain | 5/424 |
| 5,956,787 A | | 9/1999 | James et al. | |
| 6,243,894 B1 | | 6/2001 | Kosumsuppamala et al. | |

OTHER PUBLICATIONS

Posey company catalog, pp. CA29, CA52, and CA53. Date, volume, etc., unknown. The Posey company is based in Arcadia, California, and has website at http://www.posey-.com.

* cited by examiner

*Primary Examiner*—Michael F. Trettel
(74) *Attorney, Agent, or Firm*—Eric W. Cernyar

(57) ABSTRACT

A bolster system for a patient support surface is provided comprising two "L"-shaped inflatable bladders configured to be positioned along the head end and left and right sides of the patient support surface, stabilizing members such as foam extending downwardly from the inflatable bladders configured to be positioned between the patient support surface and the rails of the bed, a removable bolster sheath adapted to cover the inflatable bladders and stabilizing members, and a sheet configured to extend underneath the patient support surface and thereby anchor the bolster system in place. The bolster system is particularly adaptable to therapeutic patient support surfaces comprising alternately inflatable bladders that provide percussion, vibration, and/or rotational therapy to patients.

20 Claims, 10 Drawing Sheets

BOLSTER SYSTEM FOR A PATIENT SUPPORT SURFACE

INTRODUCTION

This invention relates generally to beds, and more particularly, to hospital beds. More particularly, this invention relates to a mattress bolster system that fits between the side rails, headboard, and/or other frame portions of a bed frame and a mattress to provide lateral retaining support to a person on the mattress.

BACKGROUND OF THE INVENTION

Hospital beds, and therapeutic beds in particular, frequently have side rails to prevent patients from rolling out of bed. However, such rails typically are not sufficient, by themselves, to keep the patient centered on the bed. This is particularly true where the mattress is a therapeutic mattress with inflatable bags that alternately tilt the patient from one direction to the other.

Side bolster systems designed for beds to keep a person centered on the bed are well known in the art. For example, U.S. Pat. No. 2,644,173 to James teaches an inflatable bolster system comprising first and second inflatable side bolsters coupled together via an impervious central sheet portion overlying the mattress. The central sheet element of the James system makes it unsuitable for a therapeutic mattress because it provides an intermediate sheet layer between the patient and the therapeutic surface.

U.S. Pat. No. 4,872,228 to Bishop teaches a mattress assembly comprising first and second side bolsters positioned along first and second sides, respectively, of a mattress, where the mattress is longer than either of the first and second side bolsters, wherein the bolsters are coupled together via a conventional bed sheet that retains the bolsters in place. Bishop's bolsters, however, are filled with cushioning material such as polyester fiberfill, and so is likely to impede access to a patient lying in the bed or impede a patient's ingress onto or egress out of the bed.

U.S. Pat. No. 5,530,974 to Rains et al. teaches a side bolster system adaptable to varying-sized mattresses comprising two cushioned cylinders configured to be positioned along the longitudinal sides of a mattress, wherein the first and second side cushioned cylinders are coupled together by a sheet of fabric. The distance between the first and second side cushioned cylinders can be adjusted to accommodate varying-sized mattresses by rolling one or more portions of the coupling sheet around one or more of the cylinders. Rains' bolsters, however, are comprised with foam, and therefore cannot be deflated to facilitate ingress onto or egress from the bed.

U.S. Pat. No. 5,802,646 to Stolpmann et al. teaches a mattress structure with integral first and second side bolsters positioned along first and second sides, respectively, of the foam core of the mattress, which couples the bolsters together. Each of the first and second side bolsters includes a primary support section having a top surface and bottom surface, and a secondary support section extending upwardly from the primary support section. Stolpmann's bolsters, however, are not suitable for keeping a patient centered on a therapeutic patient support surface.

U.S. Pat. No. 5,956,787 to James et al. teaches a mattress combination comprising a pair of selectively inflatable bolsters replaceably attached to and extending along the opposing longitudinal sides of a patient support apparatus. The bolsters are attached to the patient support by means of vinyl straps that are buttoned to the patient support apparatus. The James combination, however, is not suitable for preexisting patient support apparatuses that lack such button supports.

Accordingly, there is a need for an inflatable side bolster system adaptable for use with a pre-existing therapeutic mattress, in which the bolsters can be deflated to provide better access to the patient and facilitate the patient's ingress onto or egress out of the bed. There is also a need for a bolster system that is deflatable but at the same time adapted to be securely anchored to the sides of the mattress.

SUMMARY OF THE INVENTION

The present invention is directed to a patient position maintenance device comprising a first bolster configured to be positioned along at least a substantial portion of the left side of the patient support surface; a second bolster configured to be positioned along at least a substantial portion of the right side of the patient support surface; a bolster sheath adapted to cover the first and second bolsters, the bolster sheath having first and second sides corresponding to the first and second bolsters; and a sheet coupled to the first and second sides of the bolster sheath, the sheet configured to extend underneath the patient support surface and anchor the accessory in place relative to the patient support surface. Preferably, the first bolster is configured to be positioned also along a first portion of the head end of the patient support surface, and the second bolster is likewise configured to be positioned also along a second portion of the head end of the patient support surface. Also preferably, the first bolster comprises a first inflatable bladder and the second bolster comprises a second inflatable bladder. In one embodiment, the first and second inflatable bladders each have a short tubular section and a long tubular section joined in the shape of an "L," where the short tubular section of the first inflatable bladder is joined to the short tubular section of the second inflatable bladder. Another feature of the invention has a first stabilizing member comprising foam extending downwardly from the first inflatable bladder and a second stabilizing member comprising foam extending downwardly from the second inflatable bladder.

In another embodiment, a bolster system is provided to keep a person on a patient support surface having a first bolster section including a first section of a first inflatable bladder; the first bolster section configured to be positioned along the left side of the patient support surface; a second bolster section having a first section of a second inflatable bladder, wherein the first and second inflatable bladders are separately inflatable; where the second bolster section is configured to be positioned along the right side of the patient support surface; a third bolster section joining the first and second bolster sections; the third bolster section configured to be positioned along the head end of the patient support surface, where the third bolster section comprises a second section of the first inflatable bladder and a second section of the second inflatable bladder. Another feature of this embodiment has a first stabilizing member extending downwardly from the first inflatable bladder, a second stabilizing member extending downwardly from the second inflatable bladder, and a third stabilizing member extending downwardly from said portion of the first inflatable bladder and said portion of the second inflatable bladder. Preferably, a bolster sheath is also provided which is adapted to cover the first and second bolsters, the bolster sheath having first and second sides corresponding to the first and second bolsters. Further, a sheet is coupled to the first and second sides of the bolster sheath, and is configured to extend underneath the patient support surface and anchor the bolster system in place relative to the patient support surface.

In yet another embodiment, a bolster system is provided comprising a first bolster configured to be positioned along at least a substantial portion of the left side of the patient support surface, the first bolster having a first inflatable bladder, a second bolster configured to be positioned along at least a substantial portion of the right side of the patient support surface, the second bolster having a second inflatable bladder; and a sheet coupled to the first and second bolsters, the sheet configured to extend underneath the patient support surface and anchor the accessory in place relative to the patient support surface. The first bolster also comprises a first stabilizing member extending downwardly from the first inflatable bolster and the second bolster also comprises a second stabilizing member extending downwardly from the second inflatable bolster. The first bolster may be configured to be positioned additionally along a first portion of the head end of the patient support surface; and the second bolster may also be configured to be positioned additionally along a second portion of the head end of the patient support surface, in which case the first and second bolsters share a third stabilizing member extending downwardly adjacent said first and second portions of the head end of the patient support surface.

In a further embodiment, an accessory for a patient support surface designed to keep a person centered between the left and right sides of the patient support surface is provided comprising a first bolster configured to be positioned along at least a substantial portion of the left side of the patient support surface; the first bolster comprising a first primary support section and a first stabilizing member; the first primary section being inflatable and having a top and a bottom; the first stabilizing member extending downwardly from the bottom of the first primary section; a second bolster configured to be positioned along at least a substantial portion of the right side of the patient support surface; the second bolster comprising a second primary support section and a second stabilizing member; the second primary section being inflatable and having a top and a bottom; the second stabilizing member extending downwardly from the bottom of the second primary section; and a coupler such as a sheet to couple the first bolster to the second bolster, the coupler configured to extend underneath the patient support surface.

In yet a further embodiment, a bolster system designed to keep a person on a patient support surface having left and right sides and a head end is provided, the system comprising a first bolster section having a first portion of a first inflatable bladder; the first bolster section configured to be positioned along the left side of the patient support surface; a first stabilizing member extending downwardly from the first portion of the first inflatable bladder, the first stabilizing member being configured to be positioned adjacent the left side of the patient support surface; a second bolster section having a first portion of a second inflatable bladder, wherein the first and second inflatable bladders are separately inflatable; the second bolster section configured to be positioned along the right side of the patient support surface; a second stabilizing member extending downwardly from the first portion of the second inflatable bladder, the second stabilizing member being configured to be positioned adjacent the right side of the patient support surface; a third bolster section joining the first and second bolster sections; the third bolster section configured to be positioned along the head end of the patient support surface, and the third bolster section comprising a second portion of the first inflatable bladder and a second portion of the second inflatable bladder. A third stabilizing member extends downwardly from said second portion of the first inflatable bladder and said second portion of the second inflatable bladder and is configured to be positioned adjacent the head end of the patient support surface. Also, a bolster sheath is adapted to cover the first and second bolster sections.

The present invention, as described below, recites several elements, features, objects, and advantages, one or more of which singly or in combination may present novel and nonobvious subject matter. Unless specified otherwise, no single element, feature, object, or advantage should be understood as critical to the invention, so as to limit the scope of the claims herein.

One object of the invention is to keep a patient substantially centered on the mattress.

Another object of the invention is to prevent patients from being trapped between the mattress and side rails of the bed.

Yet another object of the invention is to provide a bolster system comprised of one or more inflatable bladders, each of which can be deflated simultaneously or individually to provide easy access to the patient and to facilitate ingress onto or egress off of the bed.

A further object of the invention is to provide a bolster system that is securely anchored to the sides of the bed.

These and other objects, features, and advantages of the present invention will be readily apparent to those skilled in the art from the following detailed description taken in conjunction with the annexed sheets of drawings, which illustrate the invention.

DETAILED DESCRIPTION

Figure 1:
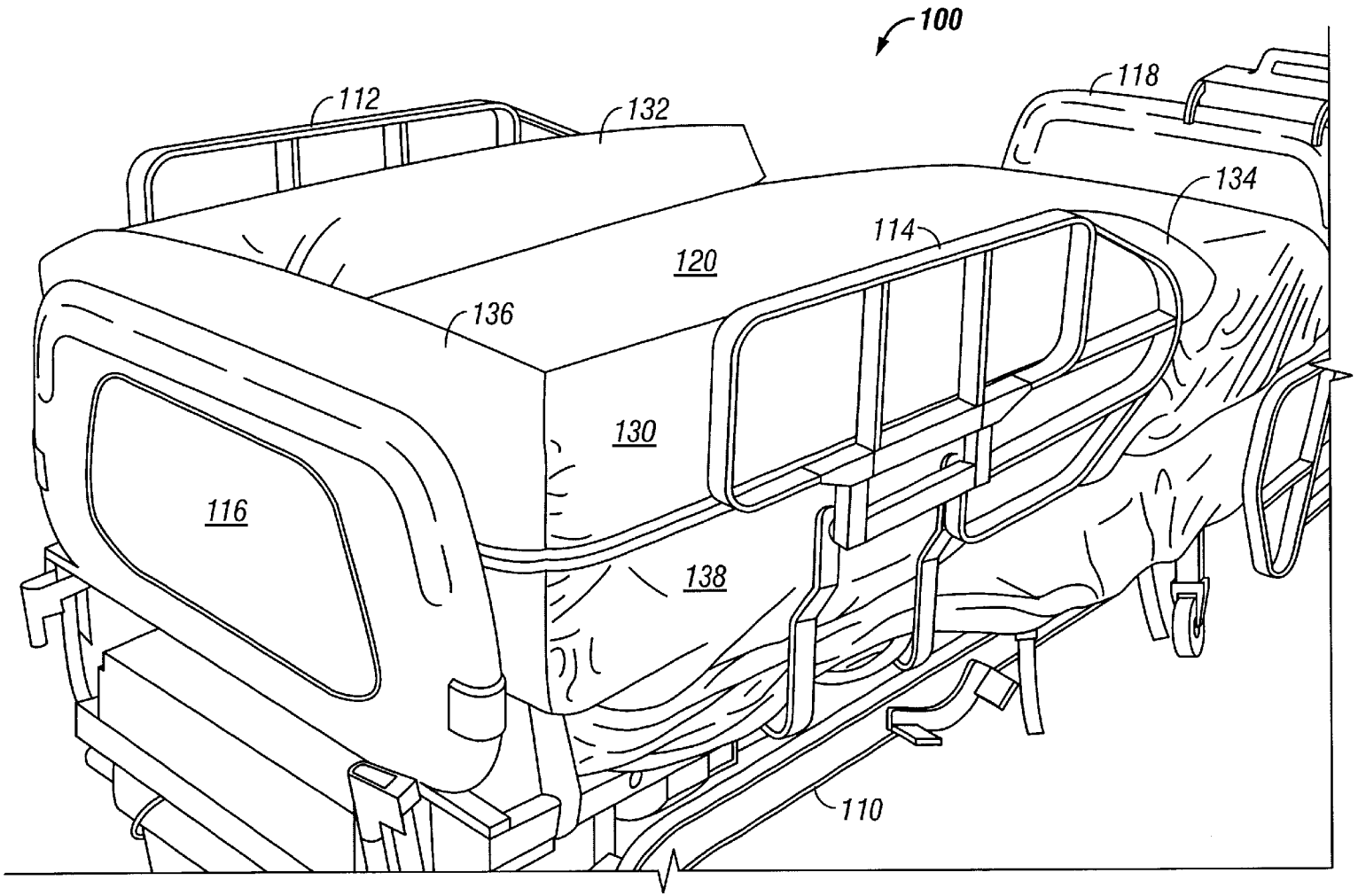
FIG. 1 is an angled perspective view of one embodiment of a bolster system of the present invention installed on a bed and mattress combination.
Figure 2:
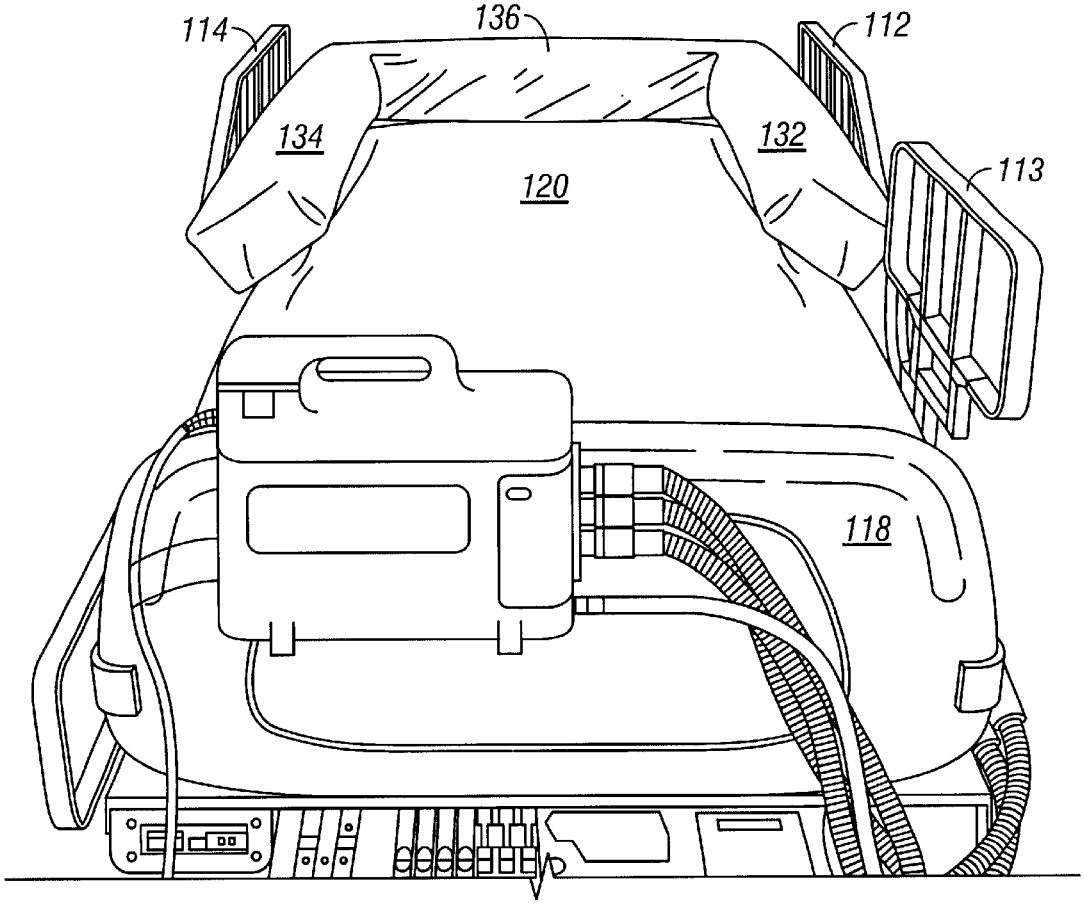
FIG. 2 is another perspective view of the bolster system of FIG. 1 from the foot end of the bed and mattress combination.
Figure 3:
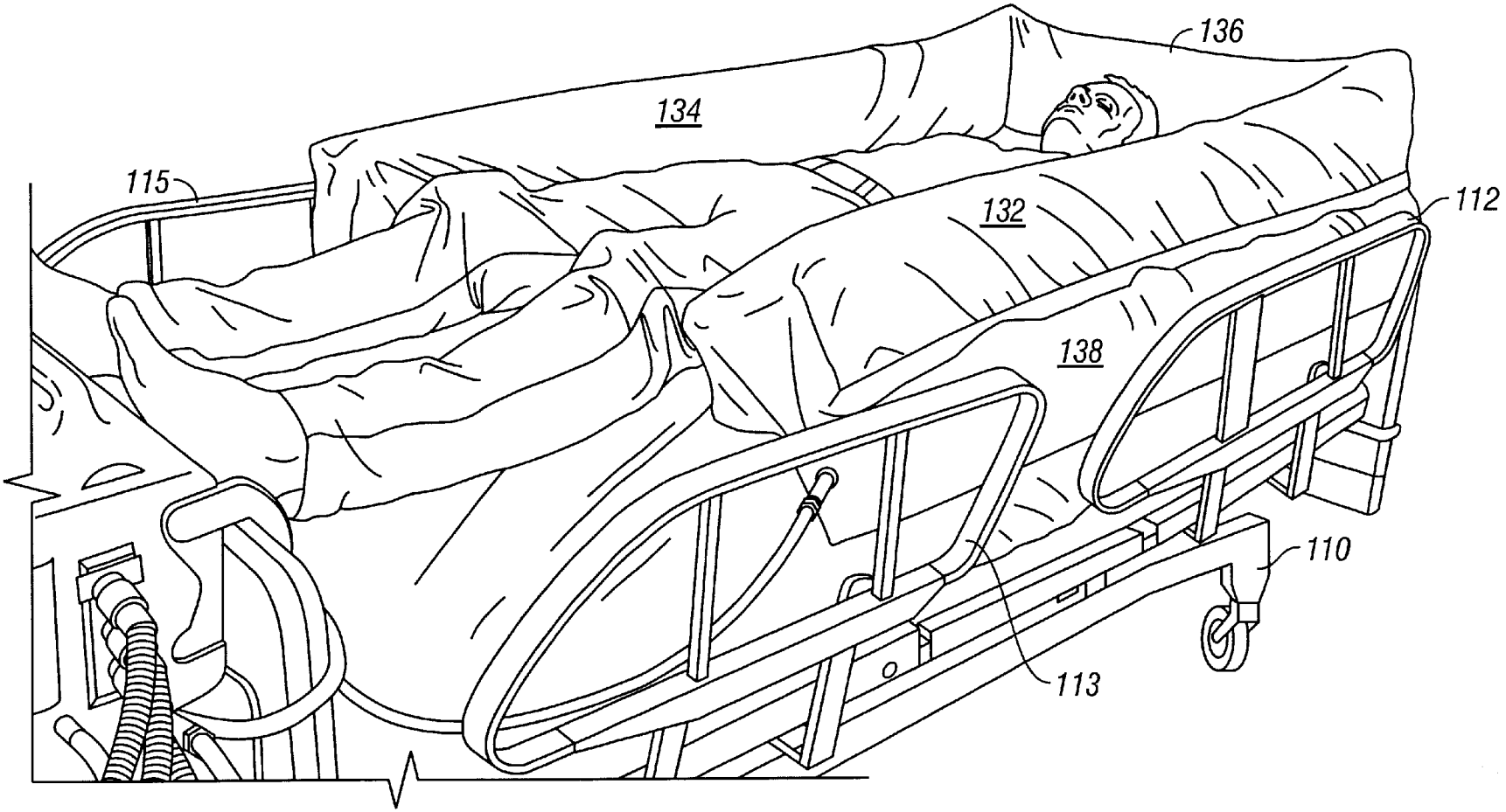
FIG. 3 is an angled view of the bolster system of FIG. 1, shown with a person lying on the mattress.

FIGS. 1–3 illustrate various angled perspective views of one embodiment of a bolster system 130 of the present invention installed on a bed frame 110 and mattress 120 combination. The bed frame 110 illustratively includes a first side rail 112, a second side rail 113, a third side rail 114, a fourth side rail 115, a headboard 116, and a footboard 118. The bolster system 130 comprises a first bolster tube 132, a second bolster tube 134, a head end bolster tube 136, and one of several anchor members 138 extending downwardly from the bolster tubes 132, 134, and 136.

Figure 4:
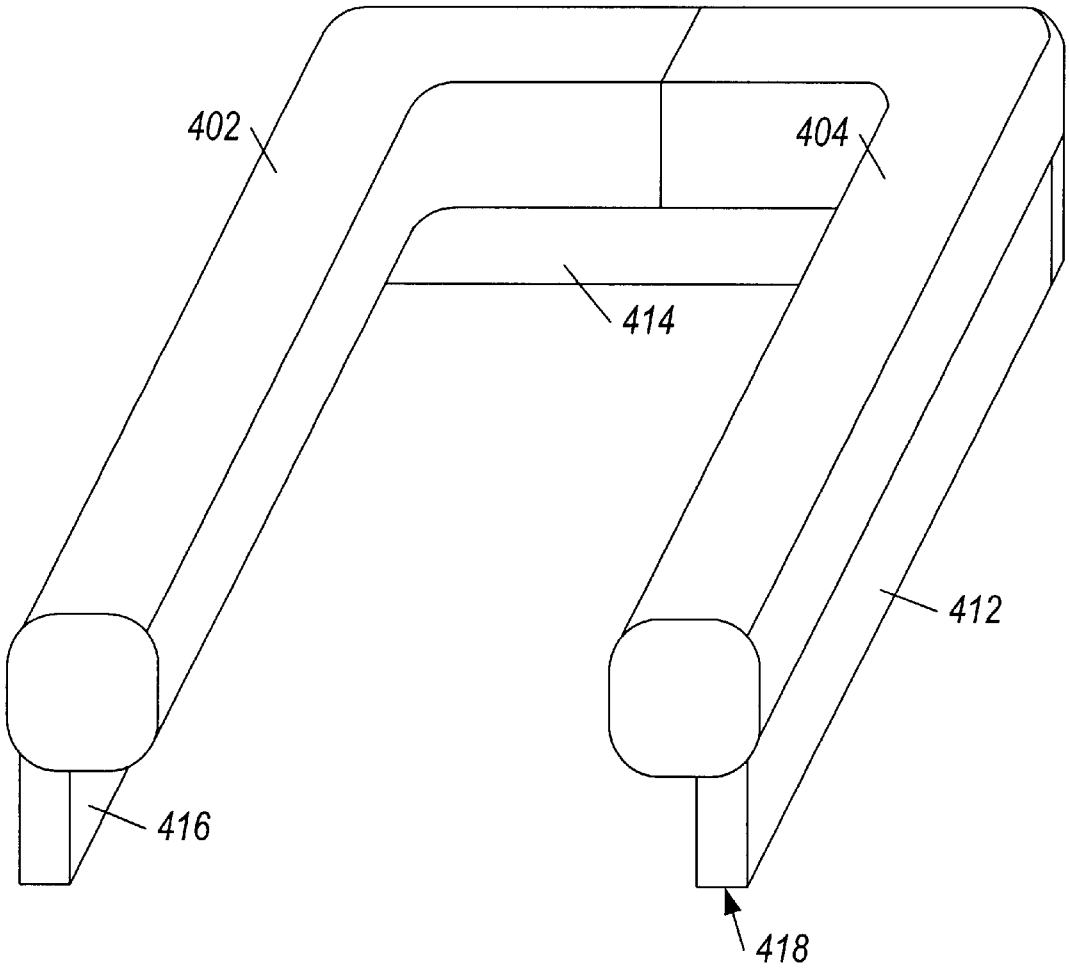
FIG. 4 is an angled perspective view of the inflatable bladders and foam sections of the bolster system of FIG. 1.

Turning now to FIG. 4, the bolster system 130 is preferably comprised of two separately inflatable L-shaped bladders 402 and 404 that are joined at the head end of the bed. The bolster system 130 is further comprised of two longitudinal foam sections 412, 416, and a lateral foam section 414. The foam sections secure the bladders 402 and 404 in place and help them to maintain the proper shape during inflation. The longitudinal foam sections 412, 416, are designed to engage the area between the mattress 120 and the side rails 112, 114 of the bed. The lateral foam section 414 is designed to engage the area between the mattress 120 and headboard 116 of the bed. In this manner, the foam sections anchor the bolster system 130 to the bed. In one embodiment, the foam sections 412, 414, 416 each have a 2 inch by 5 inch cross section. The foam sections 412, 414, 416 preferably further comprise fabric coverings that are stitched to the L-shaped bladders 402 and 404. Preferably, this fabric covering will also contain one or more zippers 418 that extend adjacent the bottom side of the foam sections 412, 414, 416 to facilitate insertion and replacement of foam into foam sections 412, 414, 416.

Of course, foam sections 412, 414, and 416 do not have to be comprised of foam. In its place, other relatively stiff materials or a heavy fluid may be used. In other alternative embodiments, sections 412, 414, and 416 may be inflatable, either separately from or integrally with inflatable bladders 402 and 404. In another alternative embodiment, the bladder and foam section subcombination may be replaced with a one or more inflatable lower-case "p" or "q" cross-sectional shaped bladders. Further alternative embodiments to any of the foregoing embodiments may have one or more sections filled with air, a heavy fluid, or a soft, compressible, and/or deformable solid.

Figure 5:
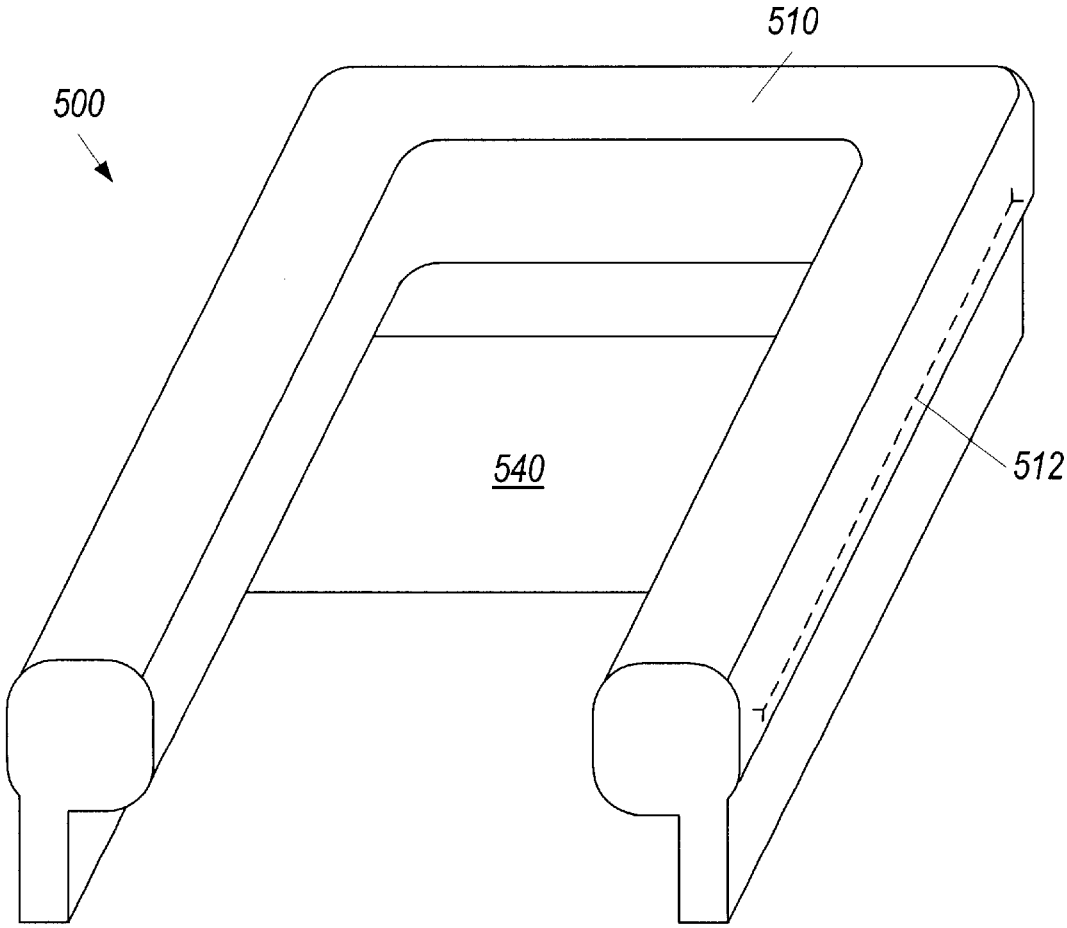
FIG. 5 is an angled perspective view of a bolster sheath for covering the inflatable bladders and foam sections of FIG. 4 including a sheet adapted to extend about the underside of a mattress.

Turning now to FIG. 5, a bolster sheath 500 is illustrated for covering the inflatable bladders 402 and 404 and foam sections 412, 414, and 416. One or more zippers 512 (only one of which is shown) are provided to facilitate insertion and replacement of the foam sections 412, 414, 416 and bladders 402, 404. A sheet 540 or other continuous fabric material adapted to laterally span the underside of the mattress functions to secure the bolster system 130 in place. The sheet 540, which may be elastic, is coupled to the bolster sheath 500 along its right, left, and top edges. Of course, the invention is not intended to be limited to a sheet 540, as other alternatives intended to secure the bolster system 130 in place could be used instead of a sheet 540.

In yet another alternative embodiment (not shown), a fourth foam section like that of foam section 414 is connected to foam sections 412 and 416 at the foot end of the bed opposite foam section 414. In a further alternative embodiment (not shown), one or more pieces of substantially stiff or rigid material, such as cardboard, extend under the bed mattress from portions of the bolster sheath 500 overlying one of foam sections 412 and 416 toward the opposite foam section, wherein each piece of substantially stiff or rigid material is coupled to only one of, but not both, the left and right sides of bolster sheath 500.

Figure 6:
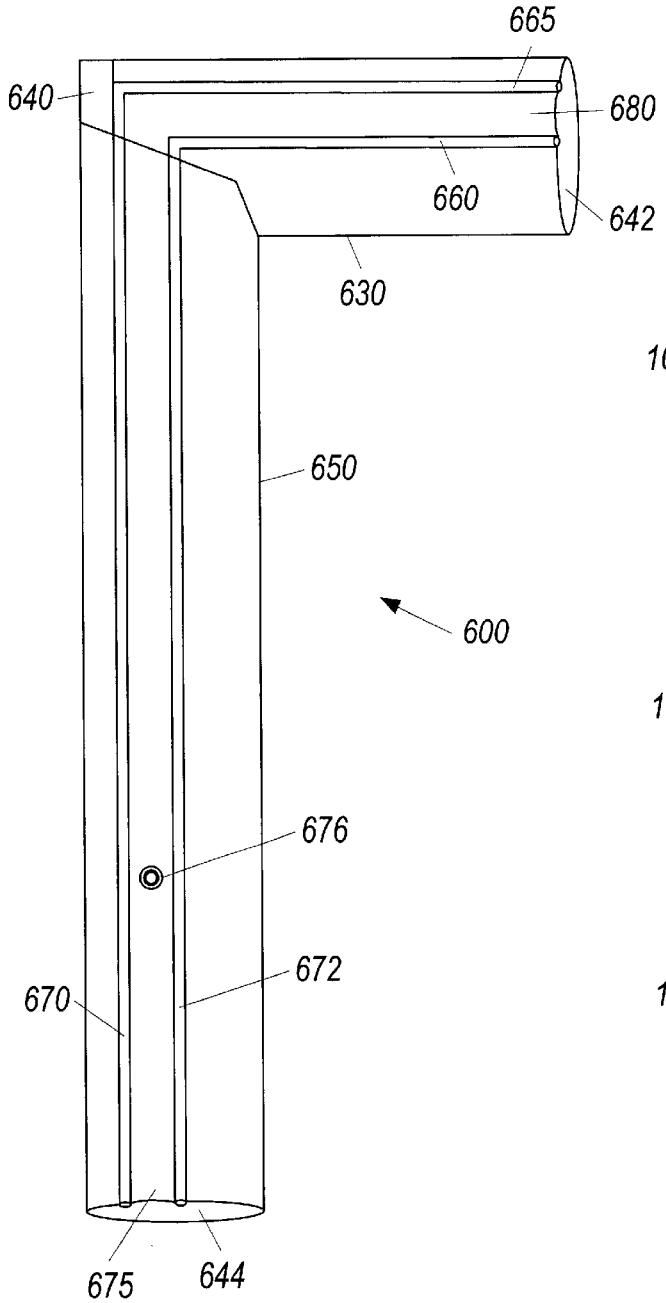
FIG. 6 is a detailed view of the bottom side of one of the inflatable bladders of FIG. 4, showing piping provided for threaded connection with the foam sections of FIG. 4.

FIG. 6 illustrates the bottom side of an inflatable L-shaped bladder 600 designed in accordance with the embodiment of FIG. 4. The bladder 600 comprises a head tube section 630 joined on opposite lateral edges to head tube piping sections 660 and 665, respectively, which are in turn joined to opposite lateral edges of a head tube baffle section 680. The bladder 600 further comprises a side tube section 650 joined on opposite longitudinal edges to side tube piping sections 670 and 672, respectively, which are in turn joined to opposite longitudinal edges of a side tube baffle section 675. Side tube section 650 is joined on the end opposite its distal end 644 to the head tube section 630 opposite its distal end 642. That joint is made complete with corner piece 640. Wall sections (not shown) seal the distal ends 642 and 644 of the head and side tube sections 630 and 650, respectively.

The piping sections 660, 665, 670, and 672 provide a place to stitch the foam sections to the bladder 600 without puncturing the bladder 600. An air inlet coupling 676 is sewn into the side tube baffle section 675, preferably at a sufficient distance from the foot end (e.g., about 18 inches) to reduce the risk of a patient who is getting in or off the bed from becoming entangled with any air inlet hose coupled to the coupling 676.

Figure 7:
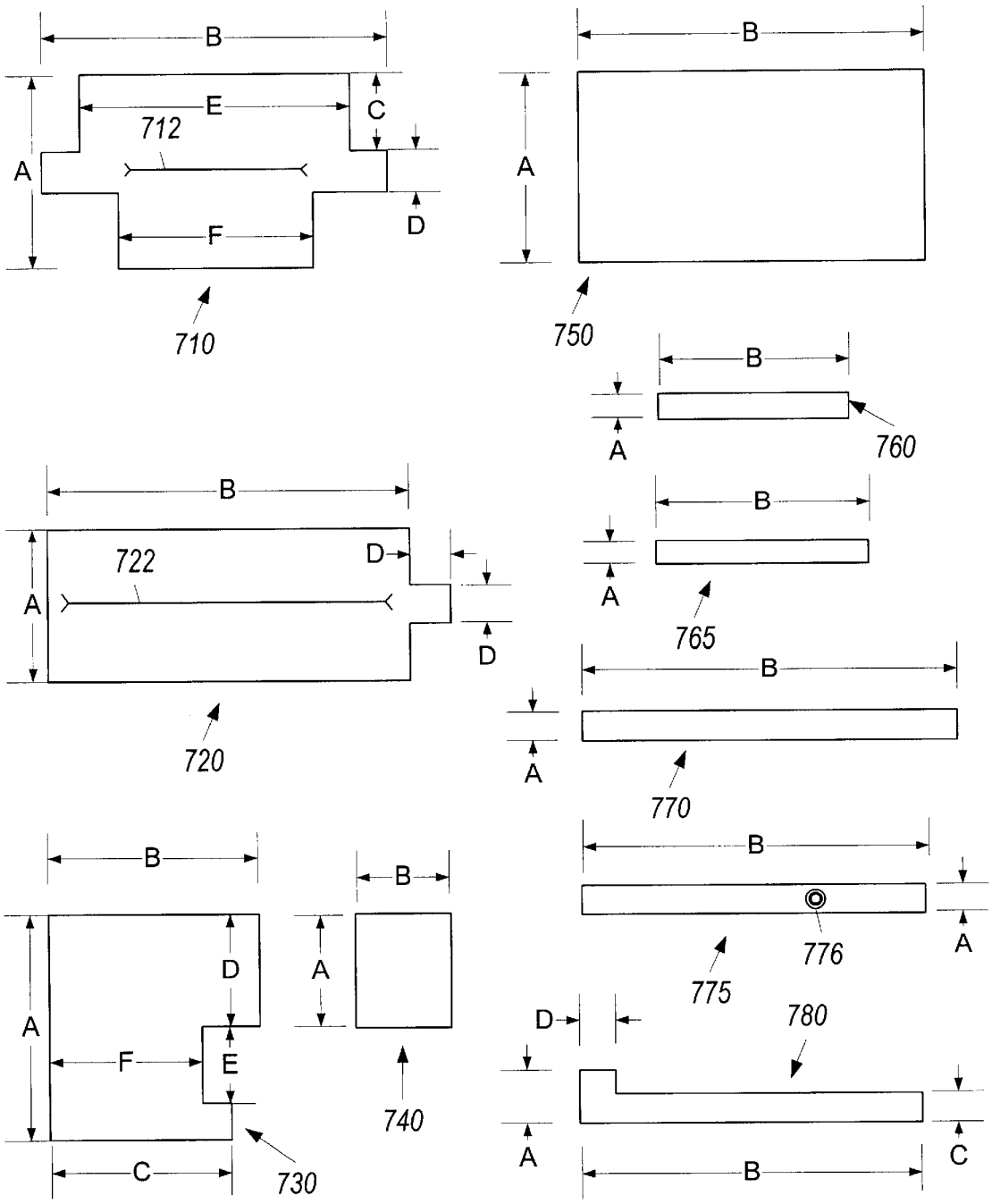
FIG. 7 illustrates the geometry of various fabric pieces, although not necessarily to scale, which are sewn together to construct the inflatable bladders and foam section covers of FIG. 4.

FIG. 7 illustrates the geometry, although not to scale, of various fabric pieces that are sewn or otherwise connected together to construct the inflatable bladders and foam section covers of FIGS. 4 and 6. The inflatable bladder pieces include one right and one left head tube section 730, six wall and face tube sections 740, two side tube sections 750, two of each of head tube piping sections 760 and 765, four side tube piping sections 770, two side tube baffle sections 775 each having an air inlet coupling 776, and one right and one left head tube baffle section 780.

In a preferred embodiment, these fabric pieces have the following dimensions, in inches:

TABLE 1 dimensions of inflatable bladder fabric sections

| | Section | | | | | | | |
|---|---|---|---|---|---|---|---|---|
| Dimension | 730 | 740 | 750 | 760 | 765 | 770 | 775 | 780 |
| "A" | 19 | 8.25 | 21.88 | 1.5 | 1.5 | 2.5 | 2.5 | 4.5 |
| "B" | 21.88 | 4 | 49.5 | 20 | 24.5 | 55 | 50 | 19.38 |
| "C" | 17 | | | | | | | 2.5 |
| "D" | 11.5 | | | | | | | 2.5 |
| "E" | 8.25 | | | | | | | |
| "F" | 15 | | | | | | | |

It should be noted that the reference numerals used to identify the inflatable bladder pieces of FIG. 7 correspond to the reference numerals used to identify the sections identified in FIG. 6. Three wall and face tube sections 740 are sewn onto each L-shaped bladder 600. One becomes the corner piece 630. Another seals the distal end 642 of the head end tube section 630. Yet another seals the distal end 644 of the side tube section 650. In light of the disclosure herein and in conjunction with the drawings, it will be apparent to those of ordinary skill in the art how these fabric pieces fit together. When constructed, the seams are preferably covered with adhesive seam seal tape.

The foam cover pieces include a head end foam cover 710 and two side body foam covers 720. In a preferred embodiment, these pieces have the following dimensions:

TABLE 2 dimensions of foam cover sections

| Dimension | Section 710 | Section 720 |
|---|---|---|
| "A" | 13.5 | 8.25 |
| "B" | 48 | 4 |
| "C" | 5.5 | |
| "D" | 2.5 | |
| "E" | 8.25 | |
| "F" | 15 | |

The head end foam cover 710 further includes a zipper 712, preferably 27.5 inches in length, to facilitate insertion and replacement of one or more foam pieces. Likewise, the side body foam covers 720 also includes a zipper 722, preferably 46.25 inches in length, to facilitate insertion and replacement of foam pieces. In light of the present disclosure, those of ordinary skill in the art will appreciate how these fabric pieces are sewn together.

Figure 8:
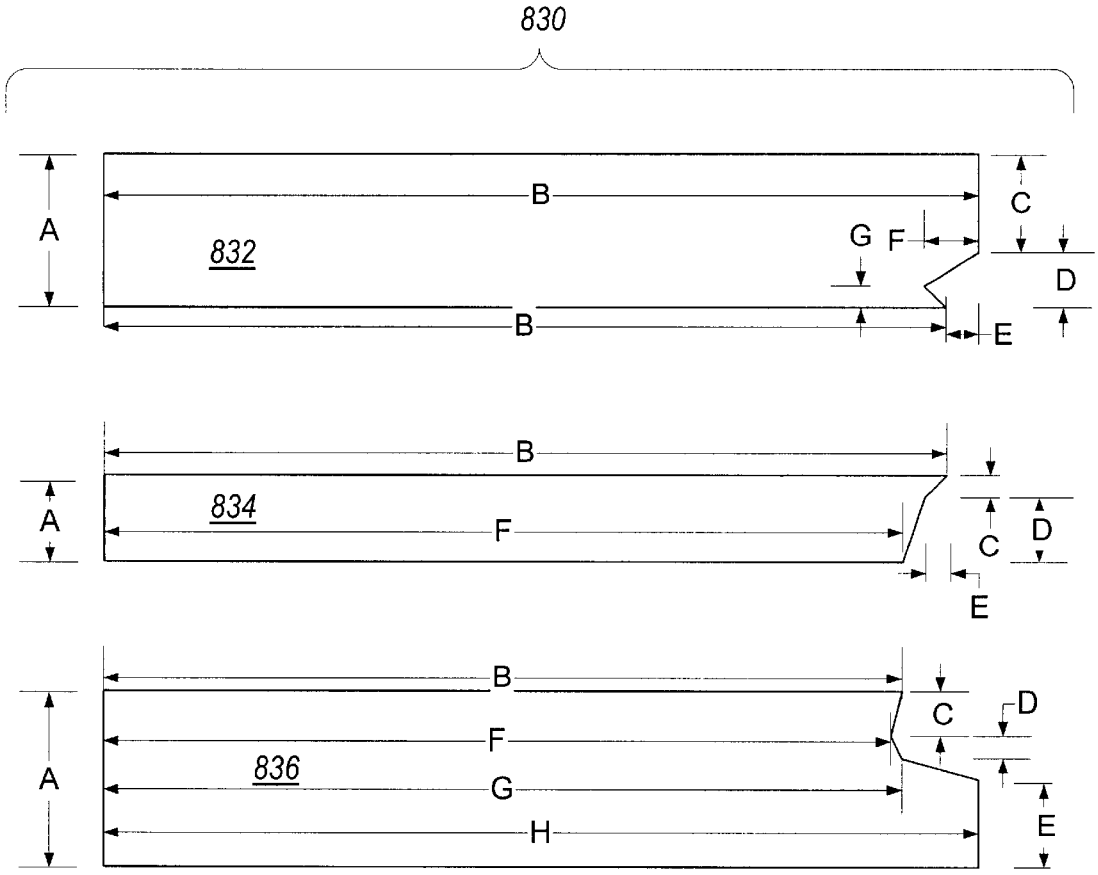
FIGS. 8 and 9 illustrate the geometry of various fabric pieces, although not necessarily to scale, which are sewn together to construct the bolster sheath of FIG. 5.
Figure 9:
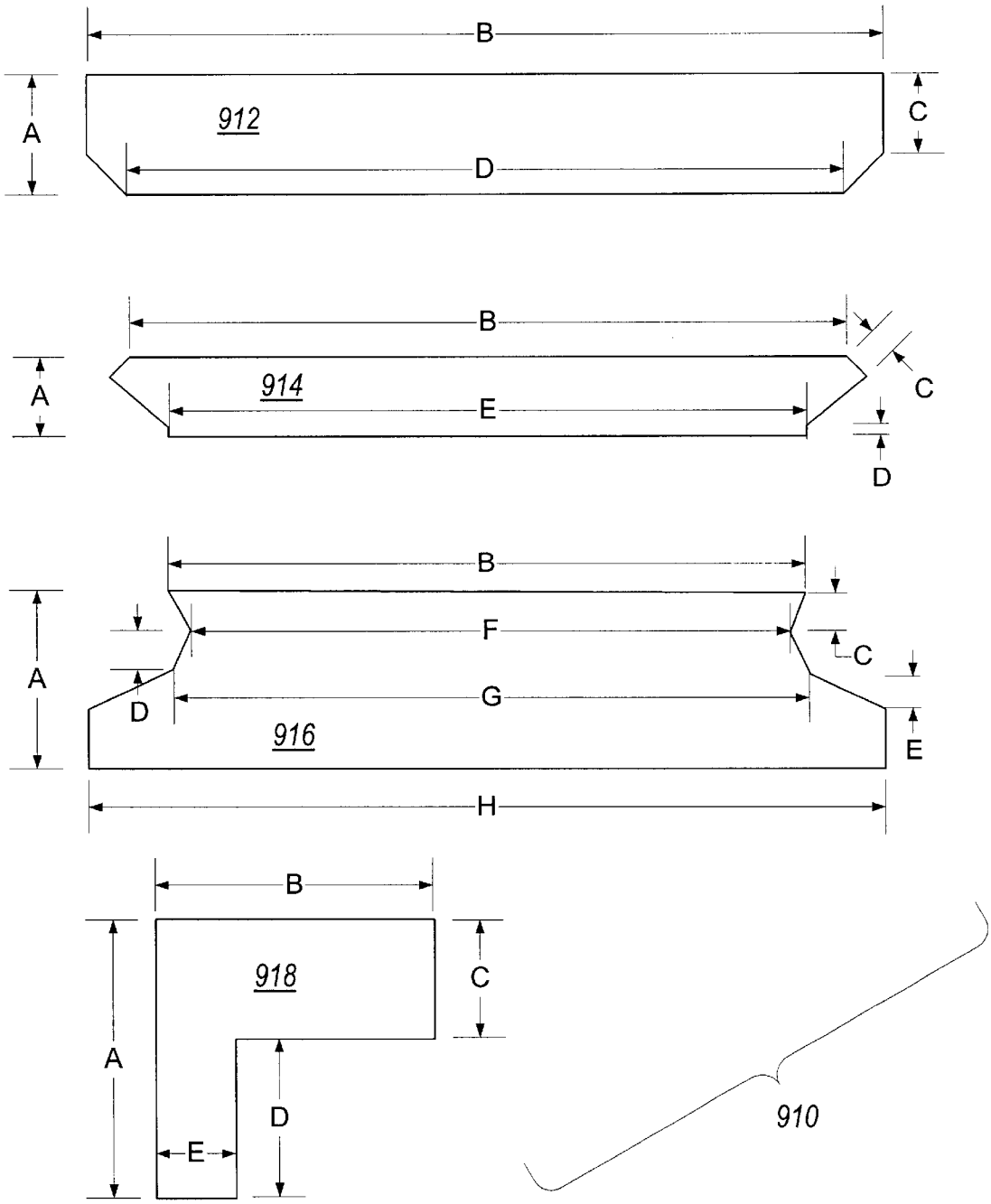

FIGS. 8 and 9 illustrate the geometry of various fabric pieces, although not necessarily to scale, which are sewn together to construct the bolster sheath of FIG. 5. FIG. 8 depicts three pieces 832, 834, and 836 that form each of the side sections 830 of the bolster sheath 500. FIG. 9 depicts a bottom portion 912, middle portion 914, top portion 916, and one of two identical corner portions 918 that together form the top section 910 of the bolster sheath 500. The fabric portion forming the sheet 540 is not depicted.

In a preferred embodiment, the fabric pieces of FIGS. 8 and 9 have the following dimensions, in inches:

TABLE 3 dimensions of bolster sheath fabric sections

| Dimension | Section 912 | Section 914 | Section 916 | Section 918 | Section 832 | Section 834 | Section 836 |
|---|---|---|---|---|---|---|---|
| "A" | 9 | 6.5 | 24 | 10.5 | 9 | 6.5 | 24 |
| "B" | 38 | 32 | 29 | 9.5 | 55 | 52.625 | 50.375 |
| "C" | 6.75 | 0.354 | 5 | 4.5 | 6.75 | 0.625 | 5 |
| "D" | 32 | 0.25 | 5.75 | 6 | 2.25 | 5.875 | 5.75 |
| "E" | | 29 | 6.25 | 3 | 2.375 | 0.625 | 7 |
| "F" | | | 28 | | 2.625 | 50.375 | 49.875 |
| "G" | | | 29 | | 0.25 | | 50.375 |
| "H" | | | 38.5 | | | | 55 |

In light of the disclosure herein and in conjunction with the drawings, it will be apparent to those of ordinary skill in the art how these fabric pieces fit together.

In a preferred embodiment, all of or at least some of the fabric pieces of the bolster sheath (or, if no bolster sheath is included, of the bladder portions themselves) are comprised of a high-air-loss fabric material which is permeable to water vapor, but impermeable to water and other liquids. One such suitable fabric material is the fabric sold under the trademark "GORE-TEX" from W. L. Gore & Associates, Inc. of Elkton, Md. This preferred material allows any moisture that may accumulate to be drawn through the vapor permeable fabric sheet and away from the patient. One advantage of such fabric choice is, of course, comfort to the patient. Another advantage of such a fabric choice is to maintain a consistent look and feel with the high air loss mattresses on which the bolster system 130 will typically be fitted.

The fabric pieces of FIG. 7, by contrast, are preferably constructed of a low-cost, impermeable material. Because it is covered by the bolster sheath, it will neither be seen nor touched by the patient. One advantage of having a bolster sheath separate from the bladder sections themselves is that the bolster sheath can easily be removed and wiped down or washed. The bladder sections, by contrast, should rarely need cleaning.

Figure 10:
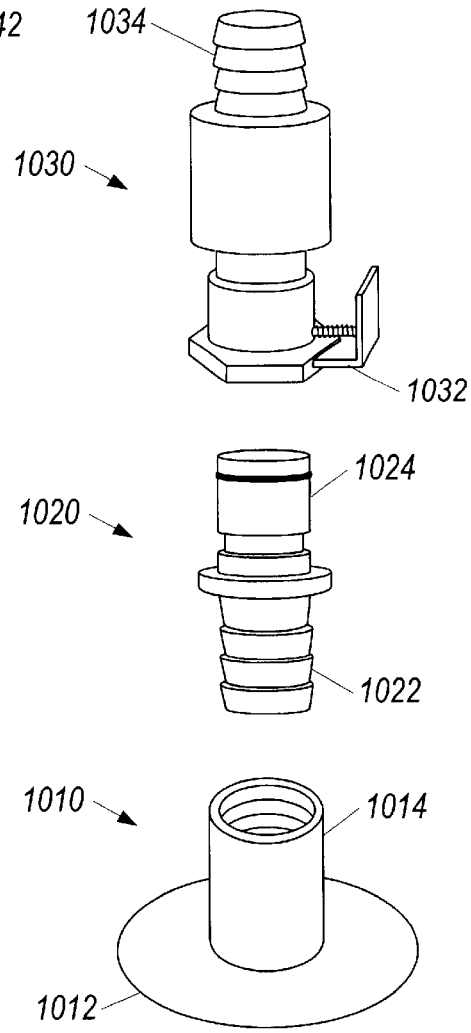
FIG. 10 is a perspective view of a quick disconnect tube assembly for connecting inflation tubes to the inflatable bladder of FIG. 4.

The bladders 402 and 404 are each preferably inflated with air, but optionally with another fluid, using inflation tubes that are connected to an air compressor. FIG. 10 illustrates a quick disconnect assembly 1000 for connecting inflation tubes to the inflatable bladders 402, 404 of FIG. 4. The assembly 1000 comprises an air inlet coupling 1010 having a ribbed ferrule 1014, a fluid conduit adapter 1020 having a ribbed male end 1022 for fitting into the ribbed ferrule 1014, and a quick disconnect valve coupling 1030 which releasably connects to the opposite end 1024 of the fluid conduit adapter 1020. The ribbed ferrule 1014 preferably has a diameter of approximately 0.375 inches. The air inlet coupling 1010 further comprises a flange 1012 preferably having a diameter of approximately 1.5 inches to provide adequate surface area for a durable threaded attachment to the bladder 402, 404. During or after manufacture, the ribbed male end 1022 of the fluid conduit adapter 1020 is inserted into the ribbed ferrule 1014 and left there. The quick disconnect valve coupling 1030 comprises a spring and clip assembly 1032 to lock the fluid conduit adapter 1020 in place. The quick disconnect valve coupling 1030 also comprises a hose barb 1034 over which an air or other fluid hose originating from the air compressor is connected.

To inflate the bladders 402 and 404, the end 1024 of the fluid conduit adapter 1020 is pressed into the quick disconnect valve coupling 1030 until the spring and clip assembly 1032 locks it in place. When fully inserted, the end 1024 of the fluid conduit adapter 1020 engages an internal valve (not shown) in the quick disconnect valve coupling 1030 which allows air to flow into, or alternatively, out of, the bladder. When disconnected, fluid can freely exit the bladders 402 and 404. In this manner, a fluid pump or compressor with one or more outlets used to inflate the bladders of therapeutic mattress may also be used to simultaneously inflate the bladders 402 and 404, without requiring any decoupling of the fluid pump or compressor from the inflatable mattress.

Figure 11:
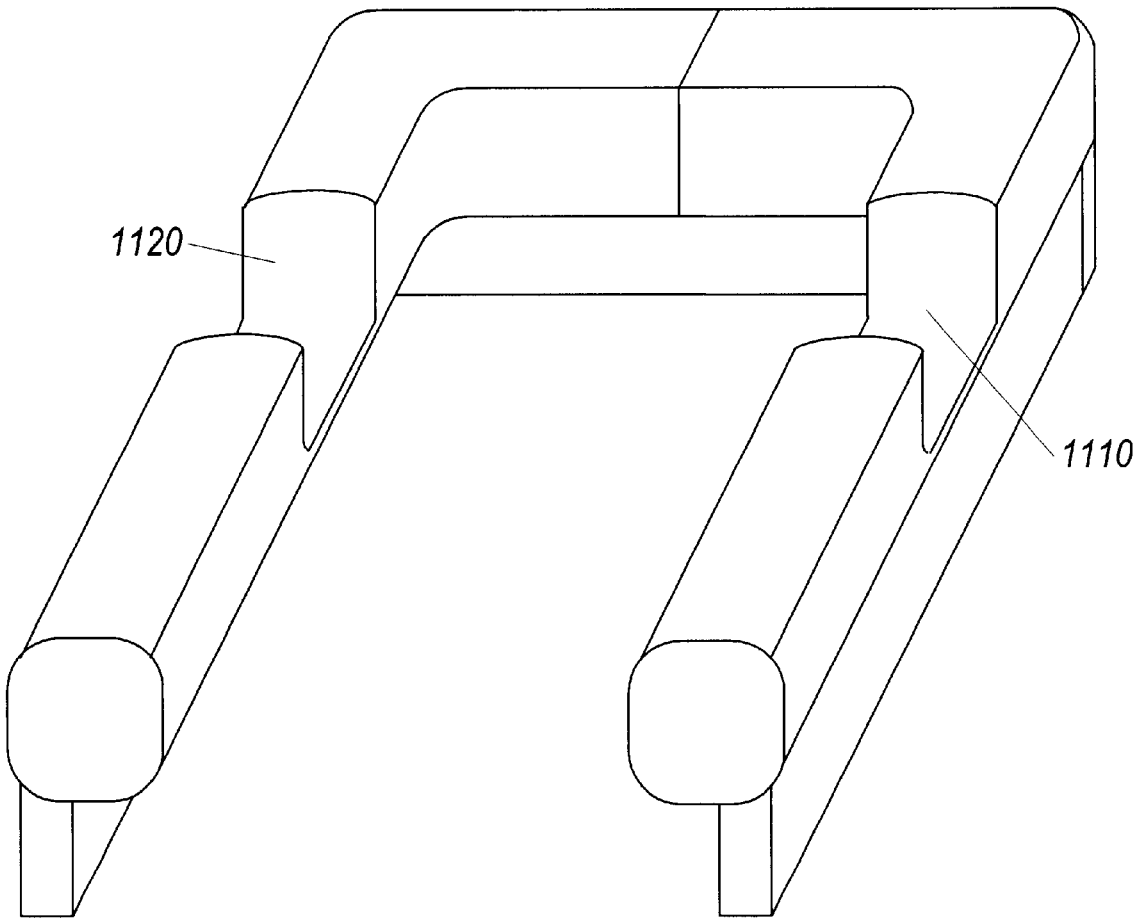
FIG. 11 is a perspective view of an alternative embodiment of a bolster system of the present invention having inflatable side bladders with shoulder access window sections.

FIG. 11 illustrates an alternative embodiment of a bolster system of the present invention having inflatable side bladders with shoulder access window sections 1110 and 1120. The purpose of this embodiment is to make the patient more visible to caretakers while at the same time providing lateral retaining support to the patient.

Although the foregoing specific details describe several embodiments of this invention, persons reasonably skilled in the art will recognize that various changes may be made in the details of the method and apparatus of this invention without departing from the spirit and scope of the invention as defined in the appended claims. Therefore, it should be understood that this invention is not to be limited to the specific details shown and described herein.

We claim:

1. An accessory for a patient support surface designed to keep a person centered between the left and right sides of the patient support surface, the accessory comprising:

a first bolster having a first long inflatable bladder section configured to be positioned along at least a substantial portion of the left side of the patient support surface;

the first bolster also having a first short inflatable bladder section joined to the first long inflatable bladder section in the shape of an "L";

a second bolster having a second long inflatable bladder section configured to be positioned along at least a substantial portion of the right side of the patient support surface;

the second bolster also having a second short inflatable bladder section joined to the second long bladder inflatable section in the shape of an "L":

the first short inflatable bladder section of the first bolster being joined to the second short inflatable bladder section of the second bolster along a head end of the patient support surface;

a first bolster sheath portion covering the first inflatable section of the first inflatable bladder;

a second bolster sheath portion covering the second inflatable section of the second inflatable bladder; and a sheet coupled to the first and second bolster sheath portions, the sheet configured to extend underneath the patient support surface and anchor the accessory in place relative to the patient support surface.

2. The accessory of claim 1 wherein the first long inflatable bladder section is integrally inflatable with the first short inflatable bladder section.

3. The accessory of claim 1, wherein the second long inflatable bladder section is integrally inflatable with the second short inflatable bladder section.

4. The accessory of claim 3, wherein the first long inflatable bladder section is integrally inflatable with the first short inflatable bladder section.

5. An accessory for a patient support surface designed to keep a person centered between the left and right sides of the patient support surface, the accessory comprising:

a first bolster configured to be positioned along at least a substantial portion of the left side of the patient support surface, wherein the first bolster comprises a first inflatable bladder and a first stabilizing member extending downwardly from the first inflatable bladder; and a second bolster configured to be positioned along at least a substantial portion of the right side of the patient support surface, wherein the second bolster comprises a second inflatable bladder and a second stabilizing member extending downwardly from the second inflatable bladder; and a bolster sheath adapted to cover the first and second bolsters, the bolster sheath having first and second sides corresponding to the first and second bolsters; and a sheet coupled to the first and second sides of the bolster sheath, the sheet configured to extend underneath the patient support surface and anchor the accessory in place relative to the patient support surface.

6. The accessory of claim 5, wherein the first stabilizing member comprises foam and the second stabilizing member comprises foam.

7. A bolster system designed to keep a person on a patient support surface having left and right sides and a head end, the system comprising:

a first bolster section having a first section of a first inflatable bladder;

the first bolster section configured to be positioned along the left side of the patient support surface;

a second bolster section having a first section of a second inflatable bladder, wherein the first and second inflatable bladders are separately inflatable;

the second bolster section configured to be positioned along the right side of the patient support surface;

a third bolster section joining the first and second bolster sections;

the third bolster section configured to be positioned along the head end of the patient support surface, and the third bolster section comprising a second section of the first inflatable bladder and a second section of the second inflatable bladder.

8. The bolster system of claim 7, wherein the first bolster section comprises a first stabilizing member extending downwardly from the first section of the first inflatable bladder;

the second bolster section comprises a second stabilizing member extending downwardly from the first section of the second inflatable bladder; and the third bolster section comprises a third stabilizing member extending downwardly from the second section of the first inflatable bladder and the second section of the second inflatable bladder.

9. The bolster system of claim 7, further comprising a bolster sheath adapted to cover the first and second bolsters, the bolster sheath having first and second sides corresponding to the first and second bolsters.

10. The bolster system of claim 9, further comprising a sheet coupled to the first and second sides of the bolster sheath, the sheet configured to extend underneath the patient support surface and anchor the bolster system in place relative to the patient support surface.

11. The bolster system of claim 10, wherein the sheet is elastic.

12. An accessory for a patient support surface designed to keep a person centered on a patient support surface having left and right sides and a head end, the accessory comprising:

a first bolster configured to be positioned along at least a substantial portion of the left side of the patient support surface;

the first bolster having a first inflatable bladder and first stabilizing member extending downwardly from the first inflatable bladder a second bolster configured to be positioned along at least a substantial portion of the right side of the patient support surface;

the second bolster having a second inflatable bladder and a second stabilizing member extending downwardly from the second inflatable bladder; and a sheet coupled to the first and second bolsters;

the sheet being configured to extend underneath the patient support surface and anchor the accessory in place relative to the patient support surface.

13. The accessory of claim 12, wherein:

the first bolster is configured to be positioned additionally along a first portion of the head end of the patient support surface; and the second bolster is configured to be positioned additionally along a second portion of the head end of the patient support surface.

14. The accessory of claim 13, further comprising a third stabilizing member that extends downwardly from the first and second bolsters adjacent the first and second portions of the head end of the patient support surface.

15. An accessory for a patient support surface designed to keep a person centered on a patient support surface having left and right sides and a head end, the accessory comprising:

a first bolster configured to be positioned partially along a substantial portion of the left side of the patient support surface and partially along the first portion of the head end of the patient support surface;

the first bolster having a first inflatable bladder;

a second bolster configured to be positioned partially along a substantial portion of the right side of the patient support surface and partially along a second portion of the head end of the patient support surface;

the second bolster having a second inflatable bladder;

a stabilizing member that extends downwardly from the first and second bolsters adjacent the first and second portions of the head end of the patient support surface; and a sheet coupled to the first and second bolsters;

the sheet being configured to extend underneath the patient support surface and anchor the accessory in place relative to the patient support surface.

16. An accessory for a patient support surface designed to keep a person centered between the left and right sides of the patient support surface, the accessory comprising:

a first bolster configured to be positioned along at least a substantial portion of the left side of the patient support surface;

the first bolster comprising a first primary support section and a first stabilizing member;

the first primary section being inflatable and having a top and a bottom;

the first stabilizing member extending downwardly from the bottom of the first primary section;

a second bolster configured to be positioned along at least a substantial portion of the right side of the patient support surface;

the second bolster comprising a second primary support section and a second stabilizing member;

the second primary section being inflatable and having a top and a bottom;

the second stabilizing member extending downwardly from the bottom of the second primary section; and a coupler to couple the first bolster to the second bolster, the coupler configured to extend underneath the patient support surface.

17. The accessory of claim 16, wherein the coupler comprises a sheet.

18. A bolster system designed to keep a person on a patient support surface having left and right sides and a head end, the system comprising:

a first bolster section having a first portion of a first inflatable bladder;

the first bolster section configured to be positioned along the left side of the patient support surface;

a first stabilizing member extending downwardly from the first portion of the first inflatable bladder, the first stabilizing member being configured to be positioned adjacent the left side of the patient support surface;

a second bolster section having a first portion of a second inflatable bladder, wherein the first and second inflatable bladders are separately inflatable;

the second bolster section configured to be positioned along the right side of the patient support surface;

a second stabilizing member extending downwardly from the first portion of the second inflatable bladder, the second stabilizing member being configured to be positioned adjacent the right side of the patient support surface;

a third bolster section joining the first and second bolster sections;

the third bolster section configured to be positioned along the head end of the patient support surface;

the third bolster section comprising a second portion of the first inflatable bladder and a second portion of the second inflatable bladder; and a third stabilizing member extending downwardly from the second portion of the first inflatable bladder and the second portion of the second inflatable bladder;

the third stabilizing member being configured to be positioned adjacent the head end of the patient support surface.

19. The bolster system of claim 18, further comprising:

a bolster sheath adapted to cover the first and second bolster sections.

20. The bolster system of claim 18, wherein:

the first and second bolster sections each comprise window section means for making the person more visible to caretakers while at the same time providing lateral retaining support to the person.

* * * * *